US006470818B1

(12) United States Patent
Mears et al.

(10) Patent No.: US 6,470,818 B1
(45) Date of Patent: Oct. 29, 2002

(54) AUTOMATIC INFLATING WATERCRAFT FLOTATION DEVICE

(75) Inventors: Arthur W. Mears; Nicolae Toderica; Valerica Grigore, all of Longmont, CO (US)

(73) Assignee: Float Rail, Inc., Boulder, CO (US)

( * ) Notice: Subject to any disclaimer, the term of this patent is extended or adjusted under 35 U.S.C. 154(b) by 0 days.

(21) Appl. No.: 09/940,975

(22) Filed: Aug. 28, 2001

Related U.S. Application Data

(63) Continuation-in-part of application No. 09/864,642, filed on May 24, 2001, which is a continuation-in-part of application No. 09/832,774, filed on Apr. 10, 2001.

(51) Int. Cl.[7] ..... B63C 9/04
(52) U.S. Cl. ..... 114/68; 114/123
(58) Field of Search ..... 114/68, 69, 345, 114/359, 360, 123

(56) References Cited

U.S. PATENT DOCUMENTS

| | | | | | |
|---|---|---|---|---|---|
| 151,400 | A | | 5/1874 | Keeler et al. | |
| 980,790 | A | | 1/1911 | Johnson | |
| 1,038,928 | A | | 9/1912 | Menzel | |
| 1,133,629 | A | * | 3/1915 | Foster | 114/123 |
| 1,220,876 | A | | 3/1917 | Moore | |
| 1,249,633 | A | | 12/1917 | Jelercic | |
| 1,622,508 | A | | 3/1927 | Harper | |
| 2,924,192 | A | * | 2/1960 | Salvage | 114/345 |
| 3,092,853 | A | * | 6/1963 | Owen | 114/68 |
| 3,822,662 | A | * | 7/1974 | Morita et al. | 114/123 |
| 4,389,961 | A | * | 6/1983 | Parish | 114/345 |
| 4,458,618 | A | | 7/1984 | Tuffier | 114/68 |
| 4,495,880 | A | | 1/1985 | Maniscalco et al. | 114/123 |
| 4,667,618 | A | | 5/1987 | Cigognetti | 114/345 |
| 4,817,555 | A | | 4/1989 | Meinen | 114/360 |
| 4,864,961 | A | | 9/1989 | Slonski | 114/360 |
| 4,867,094 | A | | 9/1989 | Binks | 114/359 |
| 4,996,936 | A | | 3/1991 | Brundritt | 114/68 |
| 5,215,031 | A | | 6/1993 | Inman et al. | 114/360 |
| 5,357,888 | A | | 10/1994 | Insinna | 114/69 |

FOREIGN PATENT DOCUMENTS

DE 3530618 A1 12/1987

* cited by examiner

*Primary Examiner*—S. Joseph Morano
*Assistant Examiner*—Lars A. Olson
(74) *Attorney, Agent, or Firm*—Emery L. Tracy

(57) ABSTRACT

A flotation device is provided comprising a carrier mounted to the watercraft with the carrier having a first cover channel, a second cover channel, a first bladder retaining slot, and a second bladder retaining slot. A space is defined between the carrier and an elongated cover having a first edge and a second edge with the first edge releasably receivable in the first cover channel and the second edge releasably receivable in the second cover channel. A cover-removing bladder is receivable within the space and secured to the carrier. A flotation bladder is receivable within the space and secured to the carrier. An inflation mechanism connected to the cover-removing bladder and the flotation bladder inflates both bladders wherein the first edge of the cover is released from the first cover channel of the carrier allowing the flotation bladder to substantially completely inflate.

20 Claims, 8 Drawing Sheets

10
20
22
14
12
21
50
52
54

Weld
Bag Befon Inflation
21
Inflation Tube
Air Supply

Inflation Tube
50, 52

Air supply
21
Small Bag Inflated

Bag Befor Weld
21
Inflation Tube

AUTOMATIC INFLATING WATERCRAFT FLOTATION DEVICE

The present application is a continuation-in-part of pending patent application Ser. No. 09/832,774, filed Apr. 10, 2001, entitled"Automatic Boat Flotation Device" and pending patent application Ser. No. 09/864,642, filed May 24, 2001, entitled "Float Switch Activation Assembly".

BACKGROUND OF THE INVENTION

1. Field of the Invention

The present invention relates to flotation devices for watercraft and, more particularly, it relates to an automatically inflating flotation device that would improve the stability of the watercraft and inhibit the watercraft from sinking if the hull was breached. The flotation device would automatically inflate when a predetermined amount of water entered the hull of the watercraft thereby increasing stability and inhibit sinking.

2. Description of the Prior Art

Boating is both a popular pastime and a vital commercial activity in much of the world today. A boat is often a substantial investment for the owner and/or operator. In the case of commercial boats, the boat is often the livelihood of the owner of the boat. As a general concept, boats sink when the hull of the boat takes on water and the boat loses its buoyancy. This can happen if the hull is breached due to a collision with some object or in heavy waves if the boat is swamped. If the boat sinks, a serious condition exists in that loss of life and loss of property often occurs.

A number of patents have been directed to inventions to prevent a boat from sinking, even if the hull was breached. Unfortunately, the previous devices for boat floatation have a number of problems such as being difficult to install and often require manual activation of the device. This is a major concern since many boats often sink unattended at the dock, not out on the open water.

The flotation device of the present invention solves these problems and others by being easy to install, either as a retrofit to an existing boat or during manufacture of the boat. In addition, the flotation device of the present invention is designed to automatically deploy when a pre-determined level of water is consistently in the hull of the vessel. The device will not deploy when water merely splashes to that level, preventing unneeded deployment in heavy seas. Once deployed the present invention will keep the boat afloat even if a complete flooding of the hull has occurred.

The primary aspect of the present invention is to provide an automatically deploying flotation device to keep the boat floating after water has partially filled the hull of the boat.

Another aspect of the present invention is to provide a flotation device that does not interfere with the looks or operation of the boat when not deployed.

Another aspect of the present invention is to provide for a flotation device that can be easily removed and a new one re-installed after deployment.

Another aspect of the present invention is to provide a device that is easy to manufacture and install.

SUMMARY

An automatically inflating boat rail is disclosed. A cover-removing bladder is folded beneath an inflatable flotation bladder which is rolled into a tight spiral. The folded cover-removing bladder and the spirally rolled flotation bladder are mounted inside a one or more piece flexible housing. The base of the housing is mounted to the outside of the hull. The base of the cover-removing bladder and the base of the flotation bladder are attached to the base of the housing. The outer part of the housing is removably attached to the base of the housing, enclosing the folded cover-removing bladder and the spirally rolled flotation bladder. One or more flotation bladders can be mounted in the housing. The flotation bladder has valves that are attached to safety valves. The safety valve is triggered by water in the hull reaching a given height in the hull. Once the safety valve is triggered, tanks of compressed inert gas are released into the system inflating the cover-removing bladder. The outer part of the housing is pushed off and the flotation bladders then commence inflation and begin unrolling. The flotation bladders can have internal chambers so that one part can be punctured without deflating the whole system.

In particular, the present invention is a flotation device for maintaining a watercraft in a floating condition. The flotation device comprises a carrier mounted to the watercraft with the carrier having a first cover channel, a second cover channel, a first bladder retaining slot, and a second bladder retaining slot. An elongated cover is secured to the carrier with the cover having a first edge and a second edge. The first edge of the cover is receivable in the first cover channel and the second edge of the cover is receivable in the second cover channel. A space is defined between the carrier and the cover. A cover-removing bladder is receivable within the space with at least a portion of the cover-removing bladder receivable within the first bladder-retaining slot. A flotation bladder is receivable within the space with at least a portion of the flotation bladder receivable within the second bladder-retaining slot. Inflation means are connected to the cover-removing bladder and the flotation bladder for inflating the cover-removing bladder and for inflating the flotation bladder subsequent to inflation of the cover-removing bladder wherein upon inflation of the cover-removing bladder, the first edge of the cover is released from the first cover channel of the carrier and is moved in a direction generally away from the watercraft allowing the flotation bladder to substantially completely inflate.

The present invention additionally includes emergency buoyant support for a watercraft. The emergency buoyant support comprises a carrier mounted to the watercraft and a cover attached to the carrier. A storage channel is formed between the base plate and the cover with a cover-removing bladder and a flotation bladder positioned within the storage channel wherein upon inflation of the cover-removing bladder, the cover-removing bladder moves the cover and the flotation bladder in a general direction away from the watercraft prior to inflation of the flotation bladder thereby allowing the flotation bladder to inflate.

The present invention further includes a method for maintaining a watercraft in a stable floating condition. The method comprises mounting a housing to the watercraft, securing a carrier into the housing with the carrier having a first cover channel, a second cover channel, a first bladder retaining slot, and a second bladder retaining slot, covering at least a portion of the carrier with a cover with the cover having a first edge and a second edge, releasably securing the first edge of the cover within the first cover channel and the second edge within the second cover channel, defining a space between the carrier and the cover, positioning a cover-removing bladder within the space with the cover-removing bladder having a first bladder edge, positioning a flotation bladder within the space with the flotation bladder having a second bladder edge, mounting the first bladder edge of the cover-removing bladder within the first bladder retaining slot, mounting the second bladder edge of the flotation bladder within the second bladder retaining slot, inflating the cover-removing bladder, and inflating the flotation bladder.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE PREFERRED EMBODIMENTS

As discussed above, the present application is a continuation-in-part of pending patent application Ser. No. 09/832,774, filed Apr. 10, 2001, entitled"Automatic Boat Flotation Device" and pending patent application Ser. No. 09/864,642, filed May 24, 2001, entitled "Float Switch Activation Assembly", assigned to the same assignee of the present invention. Both of these patent applications are hereby herein incorporated by reference.

Figure 1:
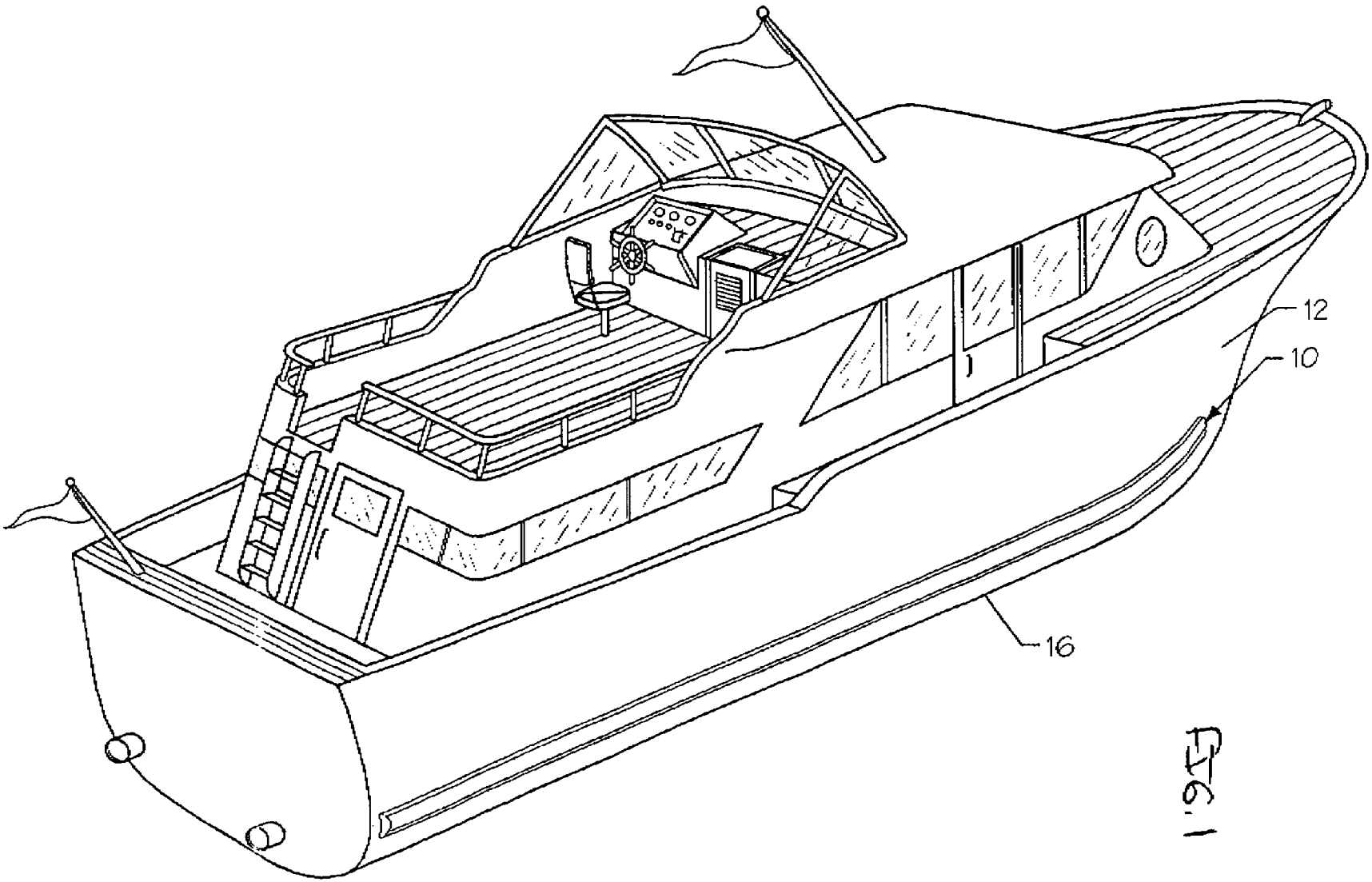
FIG. 1 is a perspective view illustrating a flotation device for inflation by a float switch activation assembly, constructed in accordance with the present invention, with the flotation device being mounted on a hull of a watercraft having a boat rail.

As illustrated in FIG. 1, the present invention is a flotation device, indicated generally at 10, mounted to a watercraft 12 and which automatically activates to maintain the watercraft 12 in a floating condition during the occurrence of a predetermined event such as water entering the watercraft 12. The flotation device 10 includes a mounting plate 14 preferably mounted on the exterior of the hull 16 of the watercraft 12. Preferably, the mounting plate 14 has a low profile and an unobtrusive visual presence, so that the mounting plate 14 does not significantly affect either the aerodynamic or visual lines of the watercraft 12 when not inflated, as described in further detail below.

Figure 2:
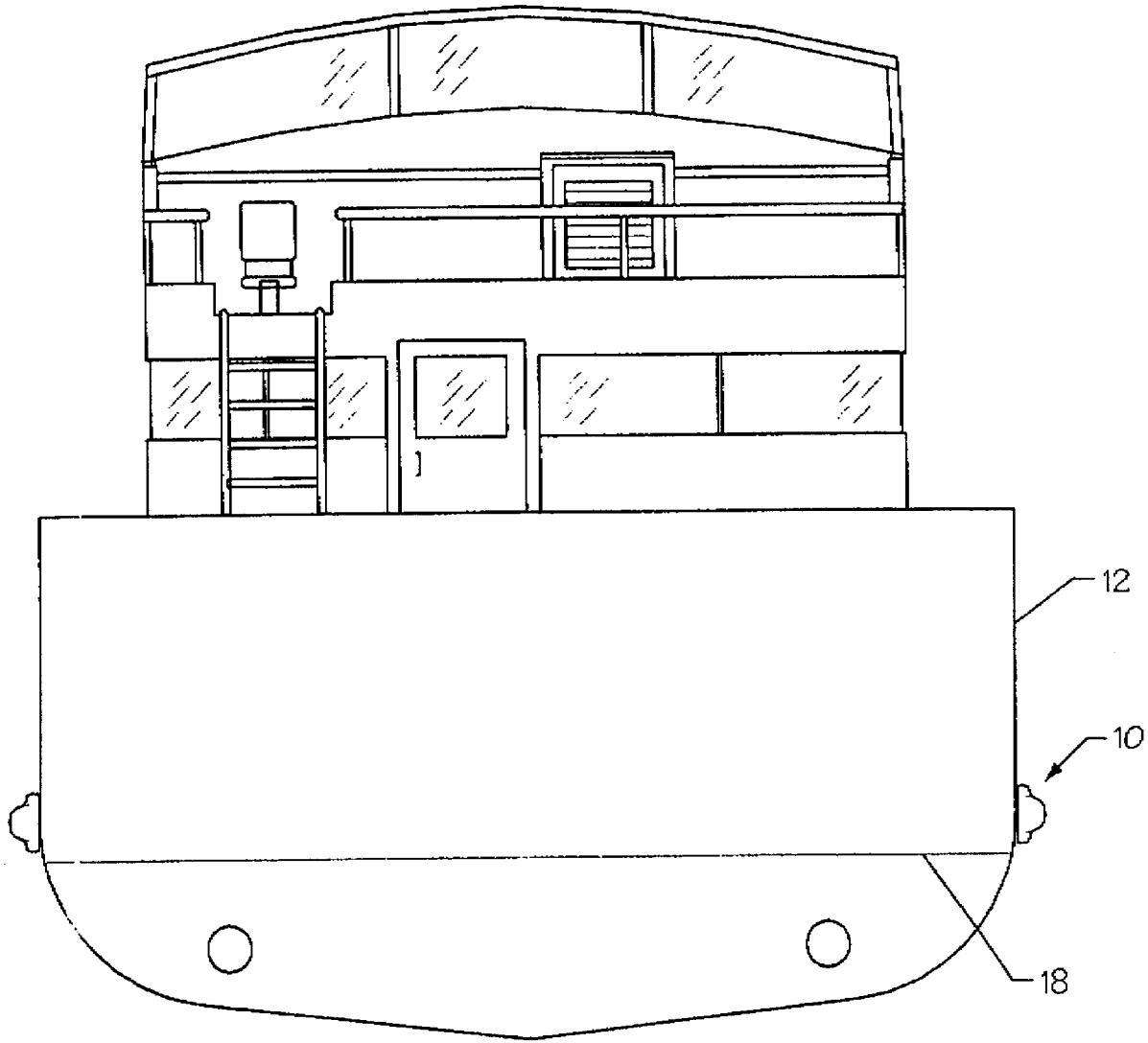
FIG. 2 is a rear view illustrating the flotation device, constructed in accordance with the present invention, with the flotation device mounted to the hull adjacent the waterline.

As illustrated in FIG. 2, the mounting plate 14 is mounted at approximately the water line 18 on the hull 16 of the watercraft 12. Furthermore, the hull 16 of the watercraft 12 can be formed with a longitudinal recess (not shown) or the like such that the flotation device 10 can be mounted within the recess thereby reducing the amount of outward extent of the flotation device 10 from the outside of the watercraft 12.

The mounting plate 14 is preferably made from aluminum or similar material although constructing the mounting plate 14 from different types of material is within the scope of the present invention. Preferably, the mounting plate 14 is mounted to the exterior of the watercraft hull 16 using either an adhesive for fiberglass and for metal hulls or screws for wood hulls (not shown). The preferred type of adhesive is a two-part epoxy. The preferred brand of epoxy is DP 190, manufactured by Minnesota Mining and Manufacturing (3M), St. Paul, Minn. Screws (not shown) may be necessary on wooden hulled boats since some adhesive only sticks to the outermost layer of paint on the exterior of the hull 16.

As illustrated in FIGS. 3–7, the flotation device 10 of the present invention further includes a carrier 20, a cover 22, a cover-removing bladder 21, and a main flotation bladder 24. The carrier 20 is slidably receivable and snaps into place within the mounting plate 14. The carrier 20 has two channels 26, 28 spaced apart from each other and extending longitudinally along the length of the carrier 20. The cover 22 has an interior surface 30, an exterior surface 32, a first hooked edge 34, and a second hooked edge 36 with the first hooked edge 34 and the second hooked edge 36 extending longitudinally along the length of the cover 22. The first and second hooked edges 34, 36 are shaped to fit in the channels 26, 28, respectively, on the carrier 20. The cover 22 can be attached to the carrier 20 by sliding the first and second hooked edges 34, 36 into the channels 26, 28.

Figure 3:
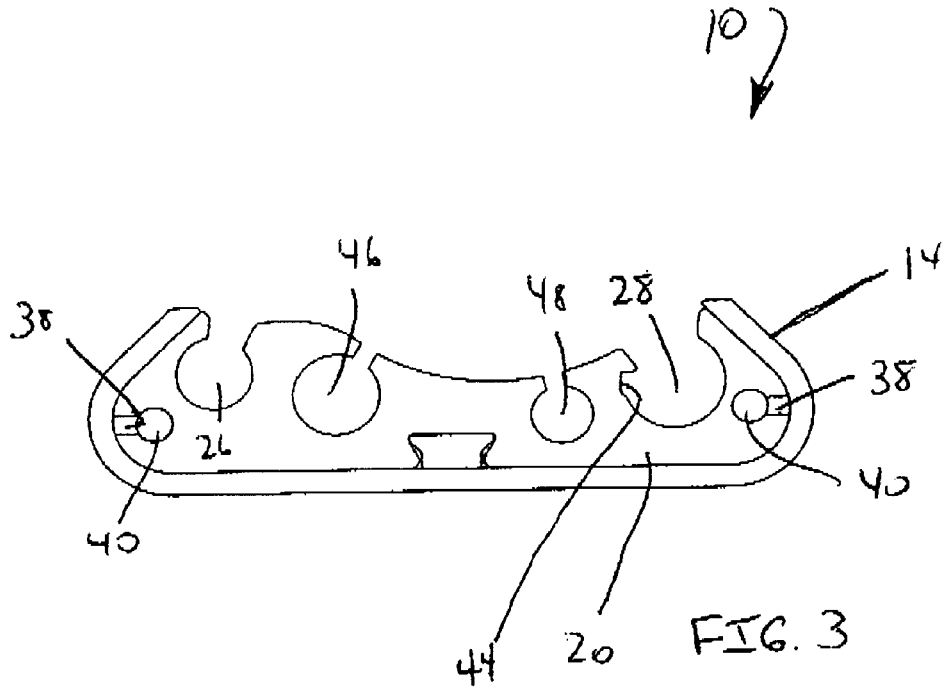
FIG. 3 is a sectional view illustrating the flotation device of FIG. 3 with the carrier slidably mounted in the mounting plate.
Figure 4:
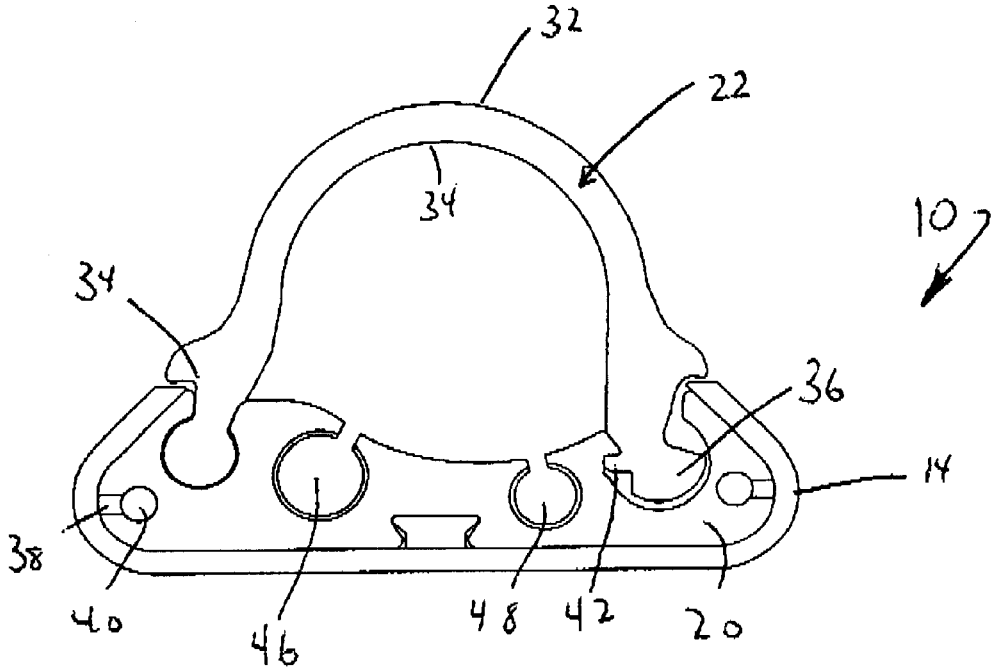
FIG. 4 is a sectional view illustrating the flotation device of FIG. 3 with the carrier slidably mounted in the mounting plate and a cover secured thereto.

In the alternative, the cover 22 can be snapped into the first and second hooked edges 34, 36. In this instance, as illustrated in FIGS. 3 and 4, grooves 38 are provided along each side of the carrier 20 to allow the carrier 20 to deform to receive the first and second hooked edges 34, 36. A dowel or rod 40 can then be inserted within the grooves 38 to inhibit further deformation of the carrier 20 and to maintain the first and second hooked edges 34, 36 within the channels 26, 28.

The cover 22 is preferably constructed from a durable material, such as thermoplastic rubber, as it is continuously exposed to the elements. When the mounting plate 14 is mounted on the hull 16 of the watercraft 12 and the cover 22 is in place, the flotation device 10 of the present invention further serves and functions as a bumper to protect the watercraft 12 as it comes in close proximity to a dock or other watercraft.

Figure 8:
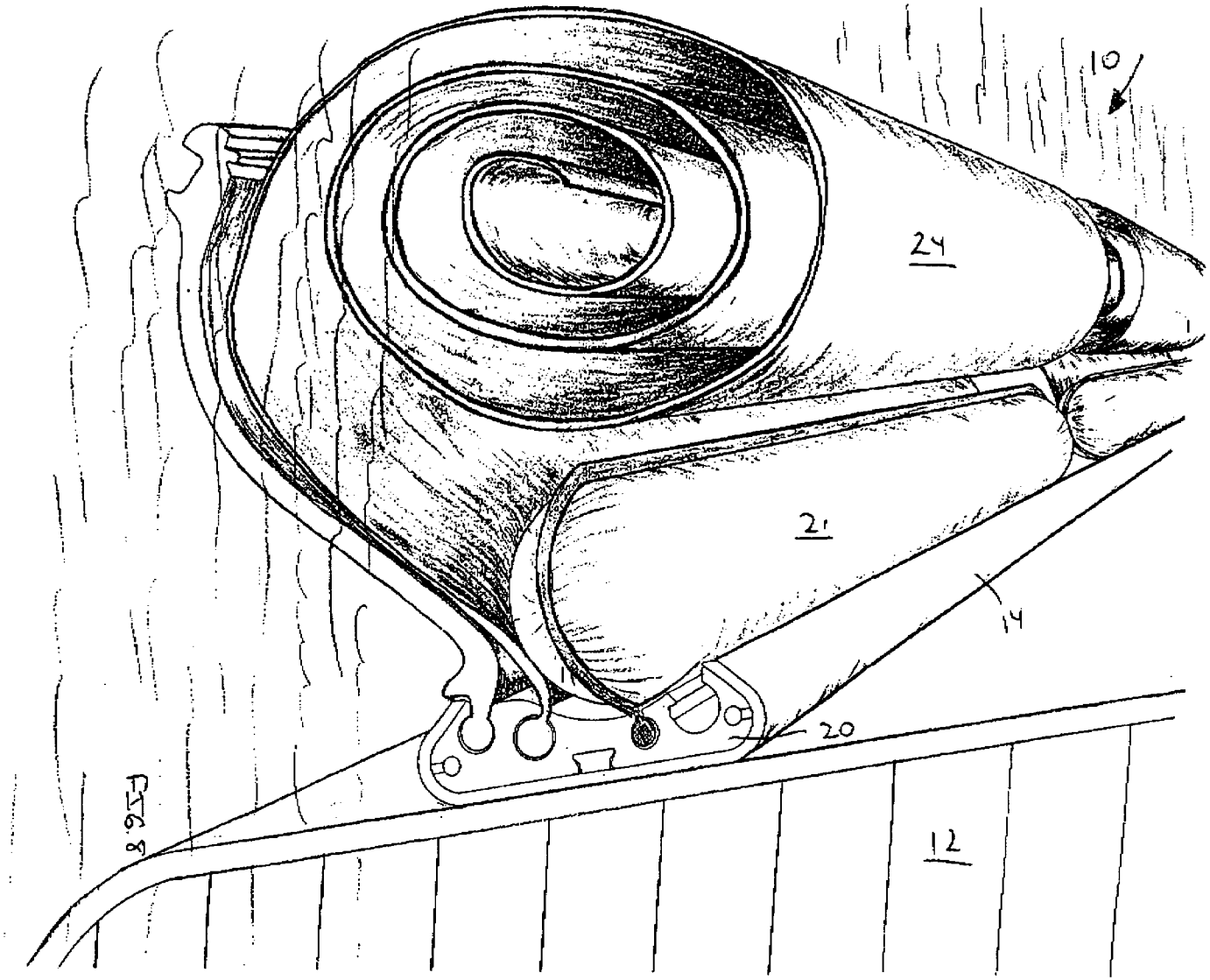
FIG. 8 is a perspective view illustrating the flotation device secured to a watercraft with the cover removed, the cover-removing bladder inflated, and the main flotation bladder in the process of being inflated.

As illustrated in FIG. 8, the first hooked edge 34 of the cover 22 will be maintained within the channel 26 before, during, and after activation of the flotation device 10. The second hooked edge 36 is releasably, securely maintained within the channel 28 until activation of the flotation device 10. Therefore, the second hooked edge 36 includes a rib 42 extending at least substantially along the length of the second hooked edge 36 and the channel 28 includes a corresponding longitudinal recess 44 corresponding to the rib 42. When the second hooked edge 36 is inserted into the channel 28, the rib 42 is received within the longitudinal recess 55 to assist in maintaining the second hooked edge 36 within the channel 28 until activation of the flotation device 10.

A first bladder retaining slot 46 and a second bladder retaining slot 48 extend along the carrier 20 between the channels 26 and 28. The first and second bladder retaining slots 46, 48 have narrowed necks at the top of the first and second bladder retaining slots 46, 48. The first and second bladder retaining slots 46, 48 can be any diameter for retaining any size bladders 21, 24 required for maintaining the watercraft 12 in a floating condition.

Figures 5, 6, 7:
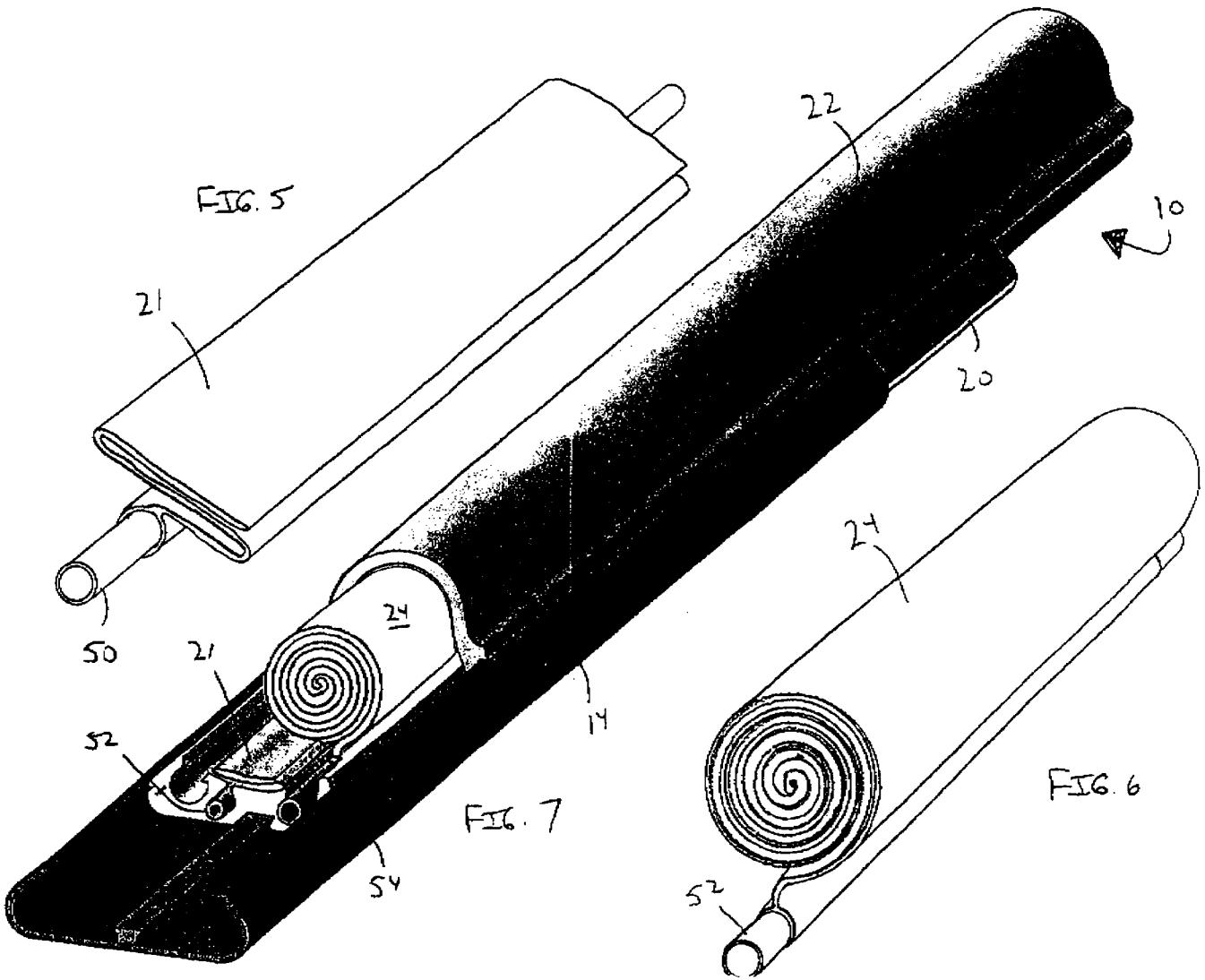
FIG. 5 is a perspective view illustrating a cover-removing bladder for the flotation device, constructed in accordance with the present invention.
FIG. 6 is a perspective view illustrating a main flotation bladder for the flotation device, constructed in accordance with the present invention.
FIG. 7 is a perspective view illustrating the flotation device, constructed in accordance with the present invention, with the main flotation bladder secured therein.
Figure 9:
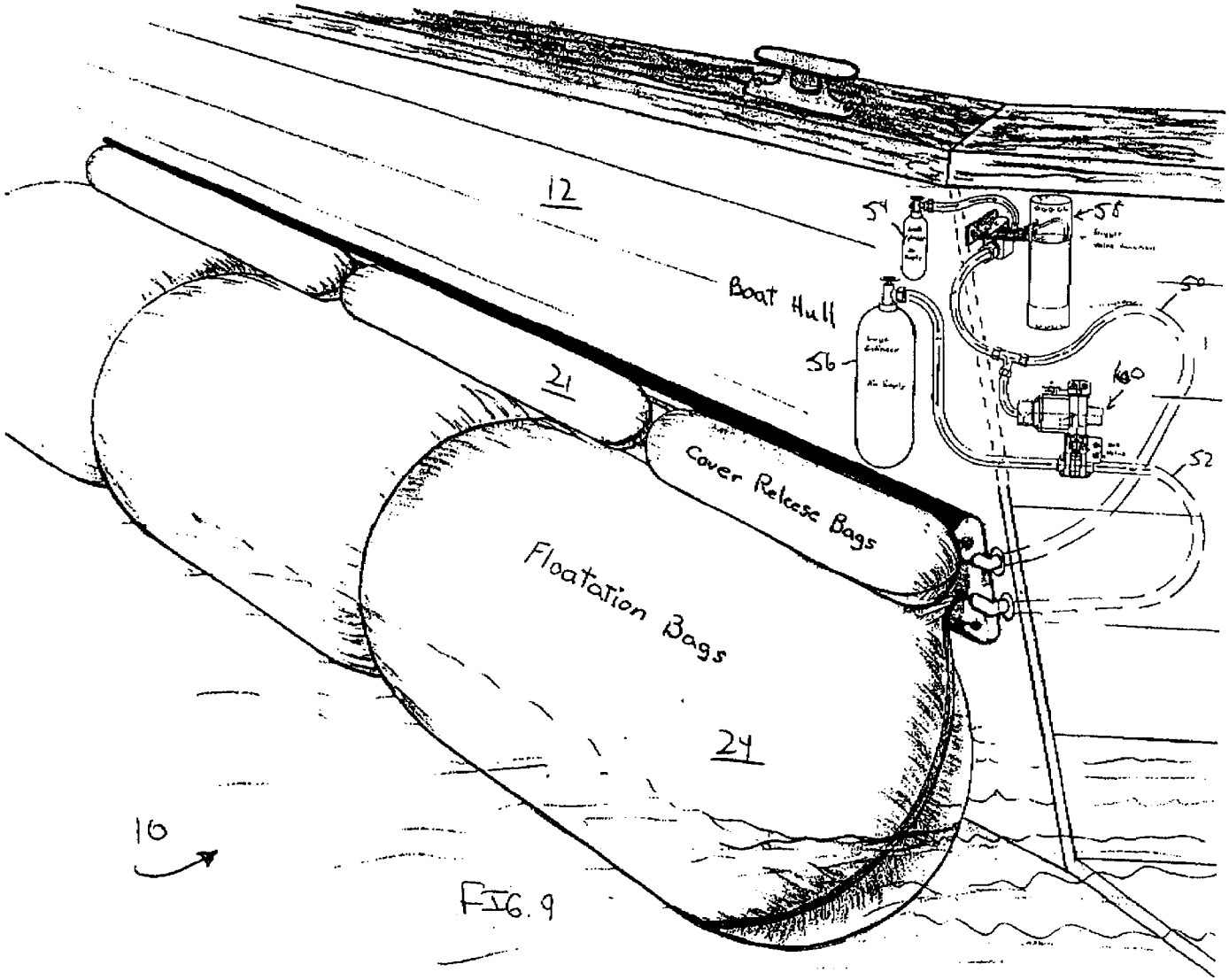
FIG. 9 is a perspective view illustrating the flotation device secured to a watercraft with the cover removed, the cover-removing bladder inflated, and the main flotation bladder inflated, the cover-removing bladder forcing the flotation bladder deeper into the water.
Figures 10, 11, 12, 13:
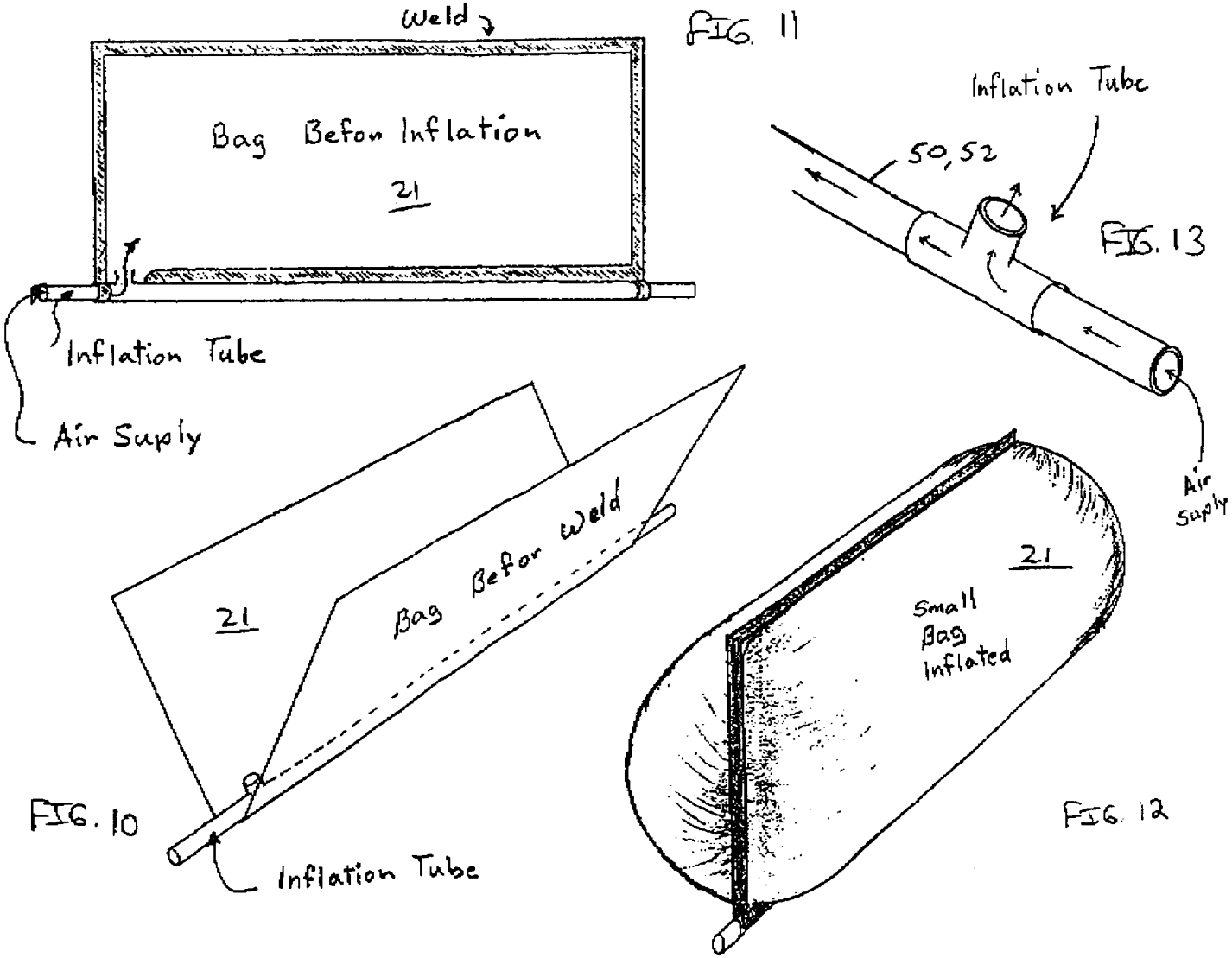
FIG. 10 is a perspective view illustrating the cover-removing bladder prior to welding.
FIG. 11 is an elevational side view illustrating the cover-removing bladder after welding in a deflated condition.
FIG. 12 is a perspective view illustrating the cover-removing bladder in an inflated condition.
FIG. 13 is a perspective view illustrating the inflation tube.

As illustrated in FIGS. 5–6, the flotation bladder 24 is folded into a substantially spiral configuration to fit between the carrier 20 and the cover 22. The cover-removing bladder 21 is folded into a substantially overlaying, serpentine manner to fit between the carrier 20 and the flotation bladder 24. As the cover-removing bladder 21 is inflated, as illustrated in FIG. 8, the second hooked edge 36 is forced from the channel 28 thereby removing the cover 22. As illustrated in FIG. 9, the flotation bladder 24 is then inflated. Actual operation of the flotation device 10 of the present invention will be described in further detail below.

As illustrated in FIGS. 10–13, preferably, the cover-removing bladder 21 and the flotation bladder 24 are made from urethane coated ballistic nylon having the edges lap welded to maintain the integrity of the bladders. It should be noted, however, that it is within the scope of the present invention to construct the cover-removing bladder 21 and the flotation bladder 24 from different types of materials and to seal the material with various types of welds, etc.

To maintain the cover-removing bladder 21 and the flotation bladder 24 within the first and second bladder retaining slots 46, 48, the cover-removing bladder 21 and the flotation bladder 24 are lap welded about a first gas supply line 50 and a second gas supply line 52, respectively. The first supply line 50 and the second gas supply line 52 are connected to a first gas supply 54 and a second gas supply 56, respectively, and receivable within the first and second bladder retaining slots 46, 48, to maintain the cover-removing bladder 21 and the flotation bladder 24 to the carrier 20. The first and second gas supply lines 50, 52 also serve as a source for filling the cover-removing bladder 21 and the flotation bladder 24 during activation of the flotation device 10.

To remove the cover 22 so that the flotation bladder 24 can be inflated, inert, compressed gas such as $CO_2$ is released from the first gas supply 54 and flows through the first gas supply line 50 to inflate the cover-removing bladder 21. As illustrated in FIG. 8, the cover-removing bladder 21 expands and removes one side of the cover 22 from the carrier 20. The cover 22 remains connected to the carrier 20 in the other channel 28 and swings out of the way of expanding flotation bladder 24.

FIG. 9 illustrates the watercraft 12 with the preferred embodiment of the flotation bladders 24 mounted to the exterior of the hull 16. The flotation bladders 24 are fully inflated from the second gas supply 56. The preferred embodiment of the cover-removing bladders 21 and the flotation bladders 24 are single bladders that are each a given length and are attached to carrier 20 individually. It should be noted that the cover-removing bladders 21 and the flotation bladders 24 can be constructed from a single bladder with each portion inflating individually. As will be noted, the cover-removing bladders 21 force the flotation bladders 24 deeper into the water thereby raising the watercraft 12 from the water and limiting the extent of sinking of the watercraft 12.

Either type of the cover-removing bladder 21 and the flotation bladder 24 can be used with any of the embodiments of the flotation device 10. The plurality of cover-removing bladders 21 and flotation bladders 24 are the preferred embodiment because they are easier to manufacture and makes the flotation device 10 easier to mount on a variety of watercrafts 12. The cover-removing bladders 21 and the flotation bladders 24 are manufactured in a given length and the needed numbers of bladders 21, 24 are positioned along the length of the hull 16.

The carrier 20 of each embodiment is made from a semi-rigid material, such as UHMW plastic. The material must be flexible enough to allow the carrier 20 to bend to match the curve of the watercraft hull 16 and to allow compression and bending under pressure. However, the material must to be rigid enough so that the inflation of the flotation bladder 24 will not dislodge the flotation bladder 24 from the carrier 20.

Figures 14, 15:
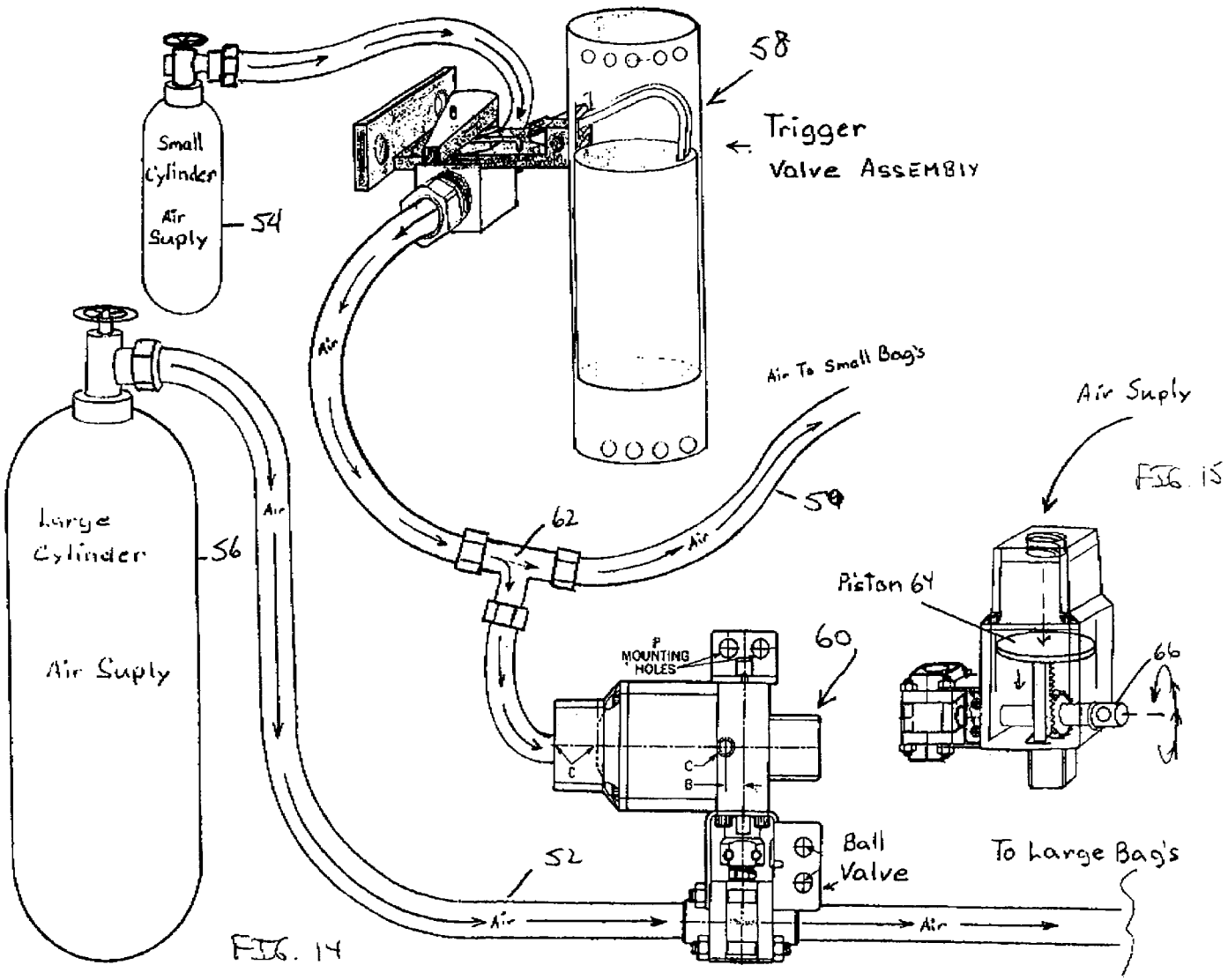
FIG. 14 is a perspective view illustrating the float switch activation assembly and the valve assembly, constructed in accordance with the present invention, with the float switch activation assembly and a compressed gas cylinder mounted to the hull of the watercraft and connected to the flotation device with tubing.
FIG. 15 is a perspective view illustrating the valve assembly, constructed in accordance, with the present invention.

As illustrated in FIGS. 14 and 15, the flotation device 10 of the present invention is activated by a float switch activation assembly, indicated generally at 58 and a valve assembly, indicated generally at 60. It should be noted that while the float switch activation assembly 58 of the present invention has been and will be described as capable of inflating the flotation device 10 on a watercraft 12, a person skilled in the art will understand that the float switch activation assembly 58 of the present invention can be used in any situation to activate a gas or fluid supply or to activate an electrical switch or chemical process. The float switch activation assembly 58 is not limited to use only on a flotation device 10 on a watercraft 12. The float switch activation assembly 58 is described in pending patent application Ser. No. 09/832,774, filed Apr. 10, 2001, entitled"Automatic Boat Flotation Device" and pending patent application Ser. No. 09/864,642, filed May 24, 2001, entitled "Float Switch Activation Assembly", assigned to the same assignee of the present invention and which are hereby herein incorporated by reference.

The float switch activation assembly 58 is mounted on the inside of the hull 16 of the watercraft 12 and is fluidly connected to the first gas supply 54. Extending from the float switch activation assembly 58 is the first gas supply line 50 connected to the cover-removing bladders 21. Upon activation of the float switch activation assembly 58, gas flows from the first gas supply 54 through the first gas supply line 50 to the cover-removing bladders 21 thereby inflating the cover-removing bladders 21 and removing the cover 22.

At a T-joint connection 62 in the first gas supply line 50, the valve assembly 60 is connected to the first gas supply line 50. As the gas flows to the cover-removing bladders 21, the gas also flows to the valve assembly 60 through the T-joint connection 62. The valve assembly 60 is also connected to the second gas supply 56 through the second gas supply line 52. The valve assembly 60 comprises a piston 64 which is forced by the gas pressure flowing through the first gas supply line 50. As the piston 64 moves, a rod 66 rotates to open the gas supply from the second gas supply 56. The gas within the second gas supply 56 can then flow from the second gas supply 56 through the second gas supply line 52 to the flotation bladders 24.

The flotation device 10 of the present invention, when activated, increases the beam of the watercraft 12 thereby increasing the stability of the watercraft 12 to inhibit the watercraft 12 from tipping over during rough water conditions. The flotation device of the present invention can also provide an emergency notification signal or other type of signal based on the water level in the hull 16 of the watercraft 12.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A flotation device for maintaining a watercraft in a floating condition, the flotation device comprising:

a carrier mounted to the watercraft, the carrier having a first cover channel, a second cover channel, a first bladder retaining slot, and a second bladder-retaining slot;

an elongated cover having a first edge and a second edge, the first edge receivable in the first cover channel and the second edge receivable in the second cover channel;

a space defined between the carrier and the cover;

a cover-removing bladder receivable within the space, at least a portion of the cover-removing bladder receivable within the first bladder retaining slot;

a flotation bladder receivable within the space, at least a portion of the flotation bladder receivable within the second bladder retaining slot; and inflation means connected to the cover-removing bladder and the flotation bladder for inflating the cover-removing bladder and for inflating the flotation bladder;

wherein upon inflation of the cover-removing bladder, the first edge of the cover is released from the first cover channel of the carrier and is moved in a direction generally away from the watercraft allowing the flotation bladder to substantially inflate.

2. The flotation device of claim 1 and further comprising:

an elongated housing mountable to the watercraft, the carrier slidably mounted within the elongated housing.

3. The flotation device of claim 1 and further comprising:

a first slot formed in the carrier; and a second slot formed in the carrier;

wherein the first slot and the second slot allow deformation of the carrier allowing the first edge of the cover to be releasably receivable in the first cover channel and the second edge of the cover to be releasably receivable in the second cover channel.

4. The flotation device of claim 3 and further comprising:

a rod insertable into each the first slot and the second slot to inhibit deformation of the first slot and the second slot subsequent to receiving the first edge and the second edge, respectively.

5. The flotation device of claim 1 and further comprising:

a first gas supply tubing receivable within the first bladder retaining slot and connected to the inflation means, the cover-removing bladder being secured to the first gas supply tubing such that gas flowing through the first gas supply tubing inflates the cover-removing bladder; and a second gas supply tubing receivable within the second bladder retaining slot and connected to the inflation means, the flotation bladder being secured to the second gas supply tubing such that gas flowing through the second gas supply tubing inflates the flotation bladder.

6. The flotation device of claim 5 wherein the cover-removing bladder is inflated prior to inflation of the flotation bladder.

7. The flotation device of claim 1 and further comprising:

a float switch activating a valve upon a predetermined amount of water entering the watercraft, the valve connected to the inflation means for activating the inflation means.

8. The flotation device of claim 1 wherein the inflation means includes a first gas supply and a second gas supply, the first gas supply being connected to the cover-removing bladders and the second gas supply being connected to the flotation bladders wherein upon activation of the float switch, the gas from the first gas supply activates the gas flow from the second gas supply.

9. The flotation device of claim 1 wherein the flotation bladder comprises a plurality of flotation bladders along the waterline of the watercraft, each flotation bladder being independently inflatable.

10. An emergency buoyant support for a watercraft, the emergency buoyant support comprising:

a carrier mounted to the watercraft;

a cover attached to the carrier;

a storage channel formed between the carrier and the cover;

at least one cover-removing bladder positioned within the storage channel; and at least one inflatable flotation bladder positioned within the storage channel;

wherein upon inflation of the cover-removing bladder, the cover-removing bladder moves the cover and the flotation bladder in a general direction away from the watercraft prior to inflation of the flotation bladder thereby allowing the flotation bladder to inflate.

11. The emergency buoyant support of claim 10 wherein the carrier has a first cover channel, a second cover channel, and a first bladder retaining slot, and a second bladder retaining slot, and the cover has a first edge and a second edge, wherein the first edge is receivable in the first cover channel, the second edge is receivable in the second cover channel, at least a portion of the cover-removing bladder is receivable within the first bladder retaining slot, and at least a portion of the flotation bladder is receivable within the second bladder retaining slot.

12. The emergency buoyant support of claim 11 and further comprising:

inflation means for inflating the cover-removing bladder and the flotation bladder;

a first gas supply tubing receivable within the first bladder retaining slot and connected to the inflation means, the cover-removing bladder being secured to the first gas supply tubing such that gas flowing through the first gas supply tubing inflates the cover-removing bladder; and a second gas supply tubing receivable within the second bladder retaining slot and connected to the inflation means, the flotation bladder being secured to the second gas supply tubing such that gas flowing through the second gas supply tubing inflates the flotation bladder.

13. The emergency buoyant support of claim 12 and further comprising:

a float switch activating a valve upon a predetermined amount of water entering the watercraft, the valve connected to the inflation means for activating the inflation means;

a first gas supply connected to the first gas supply tubing and the float switch; and a second gas supply connected to the second gas supply tubing and the valve.

14. The emergency buoyant support of claim 13 wherein the float switch has a hollow body slidable within a hollow shell, the hollow shell having at least one hole for receiving water entering the watercraft.

15. The emergency buoyant support of claim 10 and further comprising:

a first slot formed in the carrier; and a second slot formed in the carrier;

wherein the first slot and the second slot allow deformation of the carrier allowing the first edge of the cover to be releasably receivable in the first cover channel and the second edge of the cover to be releasably receivable in the second cover channel.

16. The emergency buoyant support of claim 15 and further comprising:

a rod insertable into each the first slot and the second slot to inhibit deformation of the first slot and the second slot subsequent to receiving the first edge and the second edge, respectively.

17. The emergency buoyant support of claim 10 and further comprising:

an elongated housing mountable to the watercraft, the carrier slidably mounted within the elongated housing.

18. A method for maintaining a watercraft in a stable floating condition, the method comprising:

mounting a housing to the watercraft;

securing a carrier into the housing, the carrier having a first cover channel, a second cover channel, a first bladder retaining slot, and a second bladder-retaining slot;

covering at least a portion of the carrier with a cover, the cover having a first edge and a second edge;

releasably securing the first edge of the cover within the first cover channel and the second edge within the second cover channel;

defining a space between the carrier and the cover;

positioning a cover-removing bladder within the space, the cover-removing bladder having a first bladder edge;

positioning a flotation bladder within the space, the flotation bladder having a second bladder edge;

mounting the first bladder edge of the cover-removing bladder within the first bladder-retaining slot;

mounting the second bladder edge of the flotation bladder within the second bladder-retaining slot;

inflating the cover-removing bladder; and inflating the flotation bladder.

19. The method of claim 18 and further comprising:

mounting the housing to the watercraft with an adhesive material.

20. The method of claim 18 and further comprising:

automatically inflating the cover-removing bladder and the flotation bladder only upon a predetermined amount of water entering the watercraft.

* * * * *